United States Patent [19]

Shill

[11] 4,197,838

[45] Apr. 15, 1980

[54] BIRTHING BATH

[76] Inventor: Wilson T. Shill, 2000 E. Southern Ave., Tempe, Ariz. 85282

[21] Appl. No.: 955,885

[22] Filed: Oct. 30, 1978

[51] Int. Cl.[2] ..... A61H 37/00; A47K 3/12

[52] U.S. Cl. ..... 128/66; 128/361; 128/369; 4/185 L

[58] Field of Search ..... 128/66, 365, 369, 370, 128/361; 4/173, 176, 185 L

[56] References Cited

U.S. PATENT DOCUMENTS

| | | | |
|---|---|---|---|
| 3,455,299 | 7/1969 | Gerow | 128/66 |
| 3,477,069 | 11/1969 | Stiger | 4/185 L |
| 3,776,223 | 12/1973 | Yeager et al. | 128/66 |
| 3,880,154 | 4/1975 | Gabmeier | 128/66 |
| 4,128,904 | 12/1978 | Ekman et al. | 4/185 L |

*Primary Examiner*—Dalton L. Truluck
*Attorney, Agent, or Firm*—Warren F. B. Lindsley

[57] ABSTRACT

A mobile tub equipped to hold water and incorporate a movable platform which is intended to support a woman during labor and child delivery which platform prior to delivery and during labor is submerged in turbulent and temperature controlled water for relaxation purposes and during delivery is elevated to support the woman above the water.

9 Claims, 7 Drawing Figures

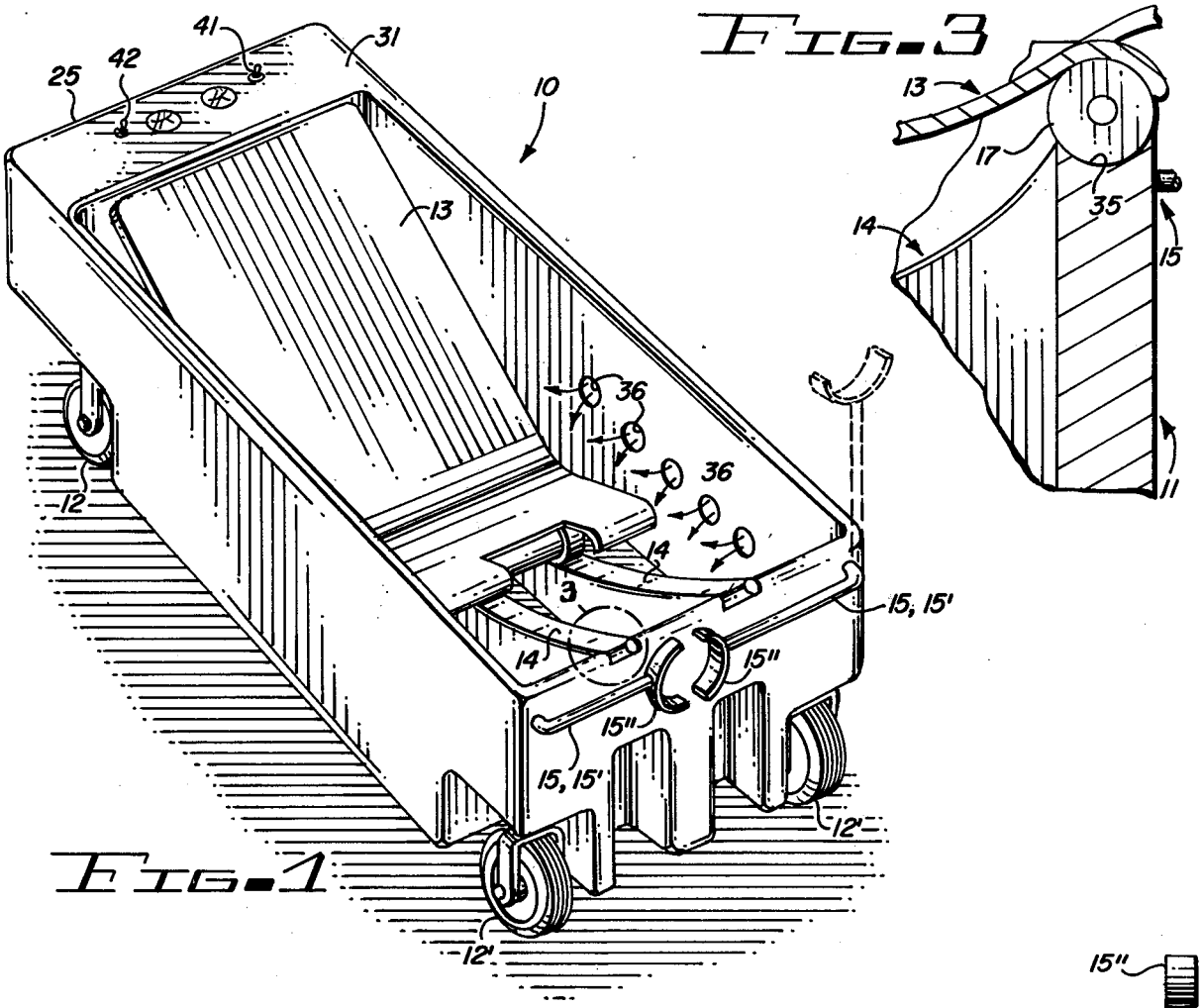
FIG. 1
FIG. 3
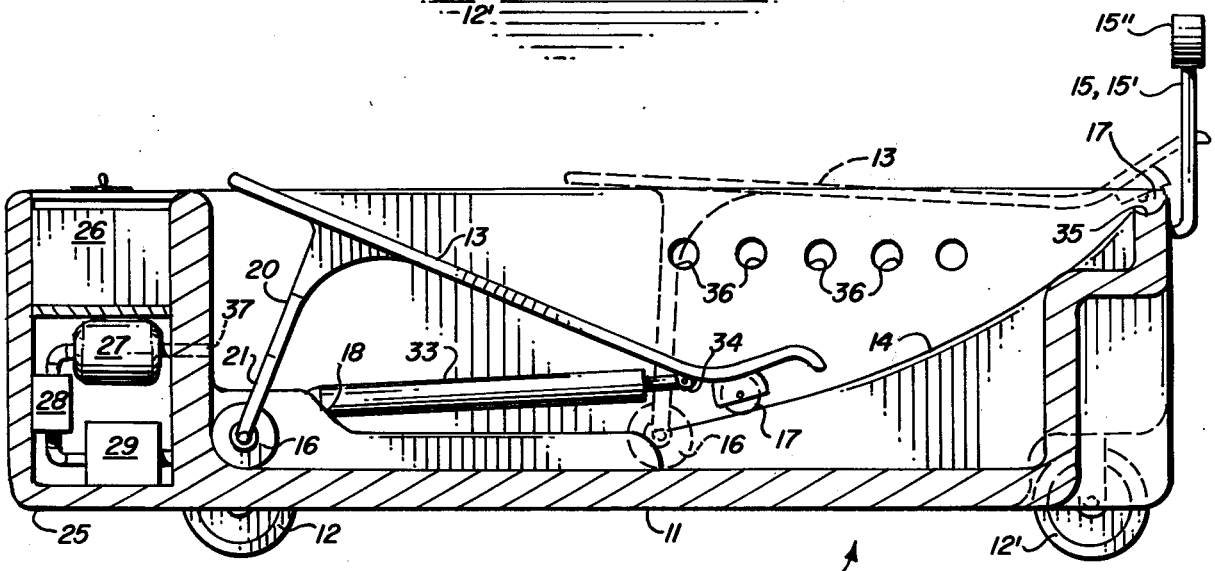
FIG. 2

BIRTHING BATH

BACKGROUND OF THE DISCLOSURE

During the advanced stages of pre-delivery labor, it is important that a woman relax since relaxation is eminently important for a successful delivery of the child with minimum chances of complications. This is especially true in the case of natural childbirth procedures. Little has been done in the past to aid the ability of the patient in this regard except through the use of drugs and such measures should be avoided in favor of more natural methods.

It is commonly accepted that a warm bath is beneficial in promoting relaxation with this effect further enhanced if the water is agitated in the manner of the currently popular whirlpool type device known as a Jacuzzi.

Accordingly, a convenient means is needed for utilizing a relaxing bath during the late stages of labor but changeable immediately to the delivery procedure. The present invention is directed toward a practical and effective arrangement and apparatus for accomplishing this purpose.

SUMMARY OF THE INVENTION

In accordance with the invention claimed, a birthing bath and associated apparatus is provided for use during childbirth which encourages relaxation and reduces pain associated with labor and delivery.

It is, therefore, one object of this invention to provide a special tank or tub and associated equipment for use in supporting a woman during labor and child delivery procedures.

Another object of this invention is to provide such a tub with provisions for surrounding the lower portions of a woman with warm water during labor thereby enhancing her ability to achieve a condition of optimum comfort and relaxation.

A further object of this invention is to incorporate into such a tub a movable platform for supporting of a woman's body with the platform being easily movable from a position in which a major part of the woman's body is submerged in the water during labor to a raised position in which the woman's body is elevated above the surface of the water during delivery.

A still further object of this invention is to provide a special tank or tub in a mobile form so that it may be readily moved from one room to another such as from a private room utilized during labor to a delivery room.

A still further object of this invention is to incorporate in the design of this special tank or tub a pair of leg supports adjustably movable from a storage position to a position for use during delivery.

A still further object of this invention is to incorporate in the design of the tank or tub a means for controlling or regulating the water temperature.

A still further object of this invention is to incorporate in the tank or tub, means for agitating or adding a desired degree of turbulence to the water.

A still further object of this invention is to incorporate in the design of the tank or tub, means for filtering the water to maintain the water in a sanitary condition throughout each period of use.

A still further object of this invention is to incorporate in the design of the tank or tub an actuator which is coupled to a platform for supporting a woman prior to and during childbirth for providing push-button control of the platform position.

A still further object of this invention is to incorporate in the design of said tank or tub a low-voltage electric storage battery for use as the power source thereby reducing the hazard of electric shock.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which:

FIG. 1 is a perspective view of a birthing bath apparatus embodying the invention;

FIG. 2 is a cross-sectional view of the birthing bath assembly shown in FIG. 1 taken along the line 2—2;

FIG. 3 is an enlarged partial view of the front part of the supporting platform shown in its raised position at the time of delivery;

DESCRIPTION OF THE PREFERRED EMBODIMENT

Figure 4:
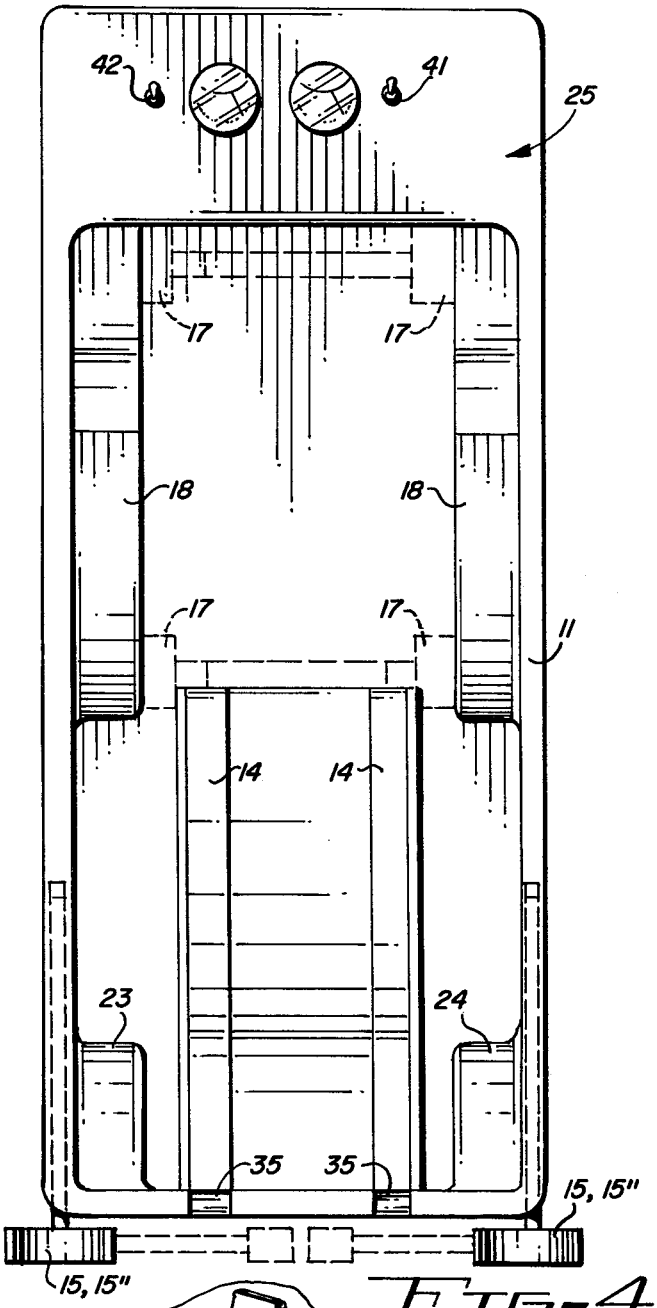
FIG. 4 is a top view of the birthing bath apparatus showing the platform leg stirrups in the positions employed at the time of delivery.
Figure 5:
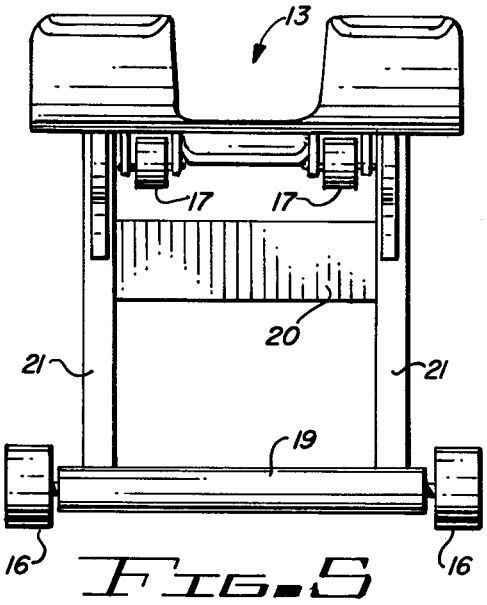
FIG. 5 is a front view of the platform assembly.
Figure 6:
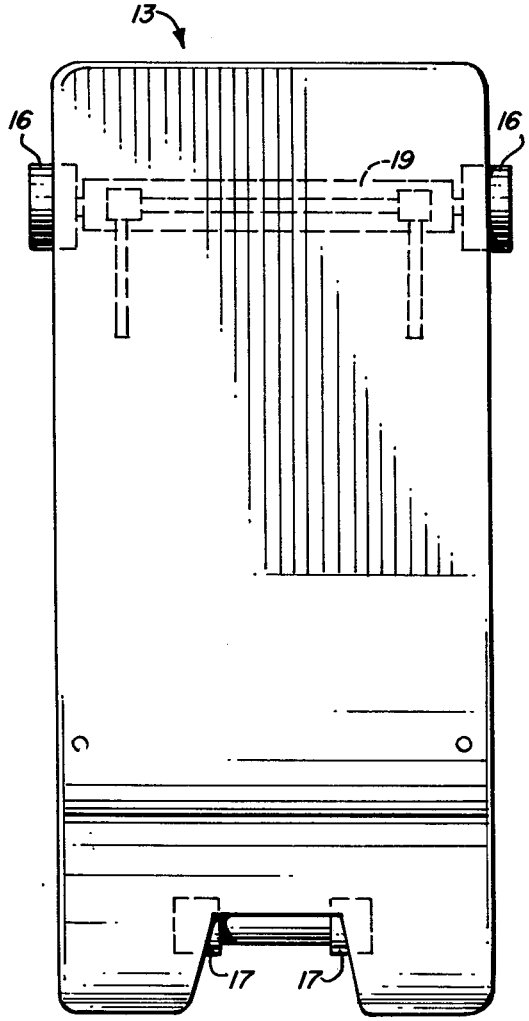
FIG. 6 is a top view of the platform assembly.
Figure 7:
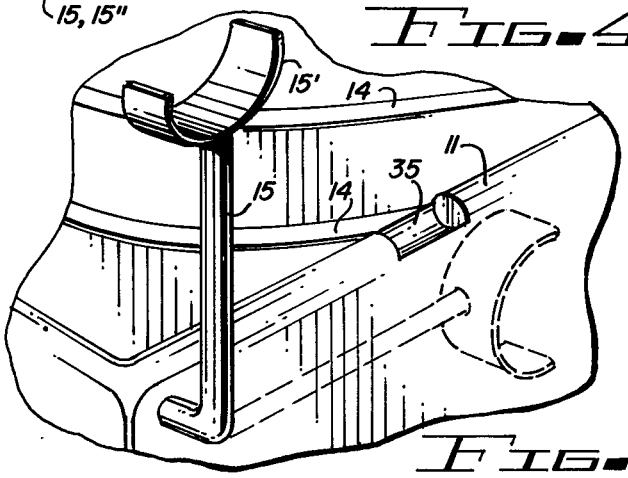
FIG. 7 is an enlarged perspective view of a stirrup in position to support a woman's leg at the time of delivery.

Referring more particularly to the drawing by characters of reference, FIGS. 1–7 show a birthing bath apparatus or device 10 in the form of a mobile, rectangular tub 11 supported on four wheels 12, 12'. A movable supporting platform 13 is located in the center of the tub 11 and is mounted on a pair of rails 14 by means of two axle mounted rear wheels 16 and two front axle mounted wheels 17. Two adjustably positioned stirrups 15 are located one at each of the two top front corners of the tub 11.

Tub 11 is of a rectangular configuration with wheels 12, 12' located one at each of the four lower corners. Two of the wheels on either end may be pivotally mounted on the structure with the other two fixed to permit maneuverability. Rails 14 located inside tub 11 are indented and slope arcuately downwardly and rearwardly from the top front edge of the tub to a point near the center of its base. Along the interior length of tub 11 running from its center to the rear section thereof are positioned shelves 18 with one positioned at each side of the tub. The spacing between these shelves is slightly greater than the overall outside dimension of platform 13 taken at a point adjacent its wheels 16.

Each of the stirrups 15 comprises an arm 15' having a U-shaped saddle 15'' at its free end and supported at its other end by a laterally extending portion 15'''. Portion 15''' of the arm is rotatably and slidably supported inside a hollow bore in the tub. The two stirrups are mounted in this manner so that they may be rotated for storage to the horizontal position shown in full lines in FIG. 1.

Platform 13 is generally rectangular in shape with a slight transverse bend located near its lower end which forms a seat for the user. Its rear wheels 16 are journaled at the ends of a shaft 19 which is secured to the bottom of the platform by means of two perpendicularly extending struts 21. The struts are attached at their upper ends to the underside of the rearward end of platform 13. A transverse web 20 is provided to stiffen the struts. The front wheels 17 are mounted under the center of the platform just rearward of its front edge. The spacing between the two front wheels 17 is such as to permit the front wheels to ride the indented rails 14. When platform 13 is mounted in tub 11, the rear wheels 17 are confined and positioned between the shelves 18 so that the shelves in cooperation with the indented rails 14 assure and maintain the alignment of the platform within tub 11.

Two small shelves 23 and 24 are located in the corners of the opposed end of the tub from shelves 18 which shelves are so designed that they provide clearance thereunder for the front wheels 12'.

Additional functional accessories of the birthing bath device 10 are mounted in an equipment compartment 25 located at the rear of tub 11 and comprise electric storage batteries 26, a water filter 27, water heater 28 and a pump 29. Operator controls are located on a control panel 31 located on the top surface of compartment 25 with additional controls located for patient operation on another control panel 32 located on one side of tub 11. In order to move the platform 13 along the ruts 14 a piston type actuator 33 is provided. This actuator comprises a cylinder 33A having a fluid actuated piston and piston rod 33B mounted therein. One end of cylinder 33A of actuator 33 is pivotally secured to the lower rear inside corner of tub 11 with the free end of its piston rod 33B pivotally attached to the forward underside of platform 13. When the piston rod 33B is extended in response to fluid pressure inside of cylinder 33A of actuator 33, platform 13 is moved forward along and up the rails 14. At the fully-forward position of platform 13, its wheels 17 come to rest in cylindrical depressions 35 at the forward terminations of rails 14. The depressions 35 serve to secure the forward position of platform 13.

In the use of tub 10 during the period of labor preceding delivery, platform 13 is moved manually to its rearward position. The patient sits or lies on platform 13 with her feet resting on shelves 23 and 24. Tub 11 is substantially filled with water which covers a major part of the patient's body. Water supplied by pump 29 flows through ducts inside the walls of tub 11 entering the interior of tub 11 through apertures 36 and then leaves tub 11 through an opening 37 in the rear wall of tub 11 and returns to pump 29 through filter 27 and heater 28.

Batteries 26 serve as a low voltage energy source for the operation of pump 29, heater 28 and associated solenoids and controls. The low-voltage source is preferred over an alternating current utility power source because it eliminates the electrical shock hazard to the patient.

During the period of labor the patient may adjust a flow rate control 38 on panel 32. Control 38 adjusts the flow rate of pump 29, thereby controlling the rate and turbulence of the water flowing through apertures 36. An adjustable Jacuzzi action is thus achieved which complements the relaxing effect of the warm water bath. The patient also has access to a temperature control 39 which is also located on panel 32. Control 39 adjusts water temperature by controlling the flow of electric current from batteries 26 to electric heater 28. The patient may thus control both water temperature and turbulence to levels she finds to be comfortable and relaxing.

The importance of maintaining the sanitary condition of the water in tub 11 will be immediately recognized. The continuous recirculation of the water through filter 27 contributes effectively toward this end.

When delivery of the baby is imminent, the birthing bath 10 is moved to the delivery room and platform 13 is moved to the forward and elevated position in which it serves as a delivery table. To move platform 13 to the forward position, a nurse or attendant raises the patient's feet and legs above the forward end of tub 11. Another attendant then operates a switch 41 on panel 25 which switch energizes a solenoid valve (not shown) which diverts the outlet of pump 29 from the ducts feeding apertures 36 to direct it into the cylinder of actuator 33. Actuator 33 responds by driving point 34 and platform 13 forward so that its forward wheels 16 travel up rails 14 and finally come to rest in depressions 35. The stirrups 15 are then raised and adjusted to comfortably support the patient's legs during child-delivery.

After delivery, the patient is removed from platform 13 and it is restored manually to the lowered rearward position.

A power on/off switch 42 located on panel 25 permits all loads to be disconnected from battery 26 when the bath 10 is not in use.

A versatile and effective birthing bath and associated equipment is thus provided in accordance with the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. A birthing bath comprising:

a tub for containing warm water for soothing a woman in labor, a track mounted in said tub and extending longitudinally thereof, a reclining platform mounted on said track for movement therealong, means for moving said platform from a first position in said tub wherein a woman reclining on said platform would have her lower extremities submerged in the water in said tub to a second position where her lower extremities are moved out of the water, and catch means for holding said platform in said second position.

2. The birthing bath set forth in claim 1 wherein:

said track is inclined toward said second position.

3. The birthing bath set forth in claim 1 wherein:

said platform is provided with wheels for moving on and along said track.

4. The birthing bath set forth in claim 1 in further combination with:

means mounted on said tub for circulating water through said tub for therapeutic benefits.

5. The birthing bath set forth in claim 1 wherein:

said catch means comprises depressions in the tube wall at one end of said track.

6. The birthing bath set forth in claim 1 in further combination with:

means mounted on the outside of said tube for filtering and heating the water in said tub.

7. The birthing bath set forth in claim 6 in further combination with:

control means mounted on said tube in position for operation by a woman in labor reclining on said platform for controlling the functioning of said means for heating the water in said tub.

8. The birthing bath set forth in claim 2 in further combination with:

a pair of spacedly positioned stirrups mounted at the end of said track on said tub adjacent said second position for holding the legs of the woman during delivery.

9. The birthing bath set forth in claim 1 wherein: said track comprises a pair of spaced rails.

* * * * *